US007290308B2

(12) United States Patent
Downey et al.

(10) Patent No.: US 7,290,308 B2
(45) Date of Patent: Nov. 6, 2007

(54) VACUUM CLEANER EQUIPPED WITH PIVOTALLY MOUNTED AGITATOR SECTION

(75) Inventors: Richard E. Downey, Danville, KY (US); Jason R. Gieske, Danville, KY (US)

(73) Assignee: Panasonic Corporation of North America, Secaucus, NJ (US)

( * ) Notice: Subject to any disclaimer, the term of this patent is extended or adjusted under 35 U.S.C. 154(b) by 569 days.

(21) Appl. No.: 10/748,633

(22) Filed: Dec. 30, 2003

(65) Prior Publication Data

US 2004/0172784 A1 Sep. 9, 2004

Related U.S. Application Data

(60) Provisional application No. 60/468,408, filed on May 6, 2003, provisional application No. 60/437,960, filed on Jan. 3, 2003.

(51) Int. Cl.
*A47I 9/04* (2006.01)

(52) U.S. Cl. ..... 15/359; 15/384; 15/377

(58) Field of Classification Search ..... 15/368, 15/371, 383, 384, 350, 393, 359, 355, 377
See application file for complete search history.

(56) References Cited

U.S. PATENT DOCUMENTS

| | | | | | |
|---|---|---|---|---|---|
| 2,266,075 | A | * | 12/1941 | Replogle | 15/377 |
| 2,291,250 | A | | 7/1942 | Nielsen et al. | |
| 2,485,671 | A | * | 10/1949 | Sparklin | 15/368 |
| 2,856,628 | A | | 10/1958 | Vance | |
| 2,874,400 | A | | 2/1959 | Burrage | |
| 2,898,621 | A | | 8/1959 | Vance | |
| 3,012,267 | A | * | 12/1961 | Kemnitz | 15/359 |
| 3,358,316 | A | | 12/1967 | Okun | |
| 3,624,861 | A | * | 12/1971 | Freiheit | 15/384 |
| 3,676,892 | A | | 7/1972 | Nordeen | |
| 3,827,103 | A | | 8/1974 | Nordeen et al. | |
| 4,426,751 | A | * | 1/1984 | Nordeen | 15/384 |
| 5,297,312 | A | | 3/1994 | Zuiderveen et al. | |
| 5,353,471 | A | | 10/1994 | Guhne et al. | |
| 5,819,370 | A | | 10/1998 | Stein | |
| 6,131,238 | A | | 10/2000 | Weber et al. | |
| 6,158,084 | A | | 12/2000 | Weber et al. | |
| 6,591,447 | B2 | | 7/2003 | Wegelin et al. | |
| 6,823,559 | B2 | * | 11/2004 | Kaffenberger et al. | 15/377 |
| 2002/0124344 | A1 | | 9/2002 | Nishikori et al. | |
| 2004/0216265 | A1 | * | 11/2004 | Peacock et al. | 15/384 |

FOREIGN PATENT DOCUMENTS

| | | |
|---|---|---|
| EP | 727171 A2 | 8/1996 |
| EP | 727171 A3 | 7/1998 |
| EP | 727171 B1 | 1/2001 |
| GB | 2336994 | 11/1999 |
| WO | WO 00/21426 | 4/2000 |
| WO | WO 00/24127 | 4/2000 |

* cited by examiner

*Primary Examiner*—Theresa T. Snider
(74) *Attorney, Agent, or Firm*—King & Schikli, PLLC

(57) ABSTRACT

The present invention relates to a floor cleaning apparatus including a nozzle assembly having a base section and an agitator section pivotally mounted to the base section, a canister assembly pivotally connected to the nozzle assembly, a suction generator carried on one of the nozzle assembly and the canister assembly and a dirt collector carried by one of the nozzle assembly and canister assembly.

17 Claims, 6 Drawing Sheets

VACUUM CLEANER EQUIPPED WITH PIVOTALLY MOUNTED AGITATOR SECTION

This application claims the benefit of U.S. Provisional Patent Application Ser. No. 60/437,960 filed Jan. 3, 2003 and U.S. Provisional Patent Application Ser. No. 60/468,408 filed May 6, 2003.

TECHNICAL FIELD

The present invention relates generally to the floor care equipment field and, more particularly, to a vacuum cleaner or other floor care device equipped with a pivotally mounted agitator section.

BACKGROUND OF THE INVENTION

Upright vacuum cleaners in all of their designs and permutations have become increasingly popular over the years. The upright vacuum cleaners generally incorporate a nozzle assembly and a canister assembly pivotally mounted to the nozzle assembly. Wheels on the nozzle and canister assemblies allow the vacuum cleaner to smoothly ride over the surface to be cleaned.

The canister assembly includes an operating handle that is manipulated by the user to move the vacuum cleaner back-and-forth across the floor. The canister assembly also includes either a bag-like filter or a separation chamber and filter combination that trap dirt and debris while substantially clean air is exhausted by a fan that is driven by an onboard electric motor. It is this fan and motor arrangement that generates the drop in air pressure necessary to provide the desired cleaning action.

In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

As the vacuum cleaner is manipulated back-and-forth by the operator with the handle on the canister assembly, the nozzle assembly may be periodically lifted slightly from the floor. This lifting action adversely affects the cleaning efficiency of the vacuum cleaner. Further, during the cleaning of certain surfaces there is a tendency for vibration to develop in the vacuum cleaner as a result of the engagement of the rotary agitator against the particular surface being cleaned. This vibration is often transmitted through the control handle and is often annoying to the user. A need is therefore identified for an upright vacuum cleaner that addresses these problems in a manner to provide enhanced cleaning efficiency as well as vibration reduction.

U.S. Pat. No. 6,772,474 to Nishikori et al, entitled Upright Vacuum Cleaner With Spring Loaded Nozzle, discloses an upright vacuum cleaner incorporating a spring loaded nozzle wherein a downforce is placed on the entire nozzle assembly in order to provide more efficient and vibration free cleaning. The present invention relates to an upright vacuum cleaner or other floor care cleaning equipment (such as a power nozzle of a canister vacuum cleaner or an extractor) incorporating an agitator assembly that is pivotally mounted to the main housing or base section of a nozzle assembly that rides on wheels traveling over the surface to be cleaned.

SUMMARY OF THE INVENTION

In accordance with the purposes of the present invention as described herein a floor cleaning apparatus is provided. That apparatus comprises a canister assembly, a nozzle assembly including a base section and an agitator section pivotally mounted to the base section, a suction generator carried by one of the nozzle assembly and the canister assembly and a dirt collector carried by one of the nozzle assembly and the canister assembly.

The agitator section includes an agitator housing and a first rotary agitator or multiple rotary agitators. In one possible embodiment the first rotary agitator includes a longitudinal axis and the agitator section pivots relative to the base section along that longitudinal axis.

The base section may include at least one ground engaging wheel. Similarly, the canister assembly may include at least one ground engaging wheel. Further, the agitator section of the nozzle assembly includes at least one wheel. Preferably, that at least one wheel of the agitator section is provided adjacent a leading edge of the agitator section so that the agitator section freely and efficiently follows the contours of the surface being cleaned.

Still further describing the invention, the canister assembly includes a control handle and the canister assembly is pivotally displaceable relative to the nozzle assembly between an upright, storage position and a use position.

In addition, a means may be provided for biasing the agitator section toward the surface to be cleaned. That means may comprise at least one spring. Further a means may be provided for transmitting power from the suction generator to the first rotary agitator. That means may include a belt and/or a gear box assembly. Alternatively the apparatus may include a separate agitator drive motor carried on the nozzle assembly.

The invention may also be defined as a vacuum cleaner comprising a main housing including a plurality of wheels for engaging and rolling over a surface to be cleaned, a suction generator carried by the main housing and an agitator section pivotally mounted to the main housing. Means such as a spring may be provided for biasing the agitator section toward the surface to be cleaned. The agitator section may include an agitator housing and a first rotary agitator. In one possible embodiment multiple agitators may also be provided. The first rotary agitator includes a longitudinal axis and the agitator section pivots relative to the main housing along that longitudinal axis.

A pair of brackets are provided for pivotally mounting the agitator section to the main housing. Each of the brackets includes an aperture for receiving an end of the first rotary agitator. Each bracket also includes at least one lug and one fastener for securing each bracket to the main housing.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawing.

Figure 5A:
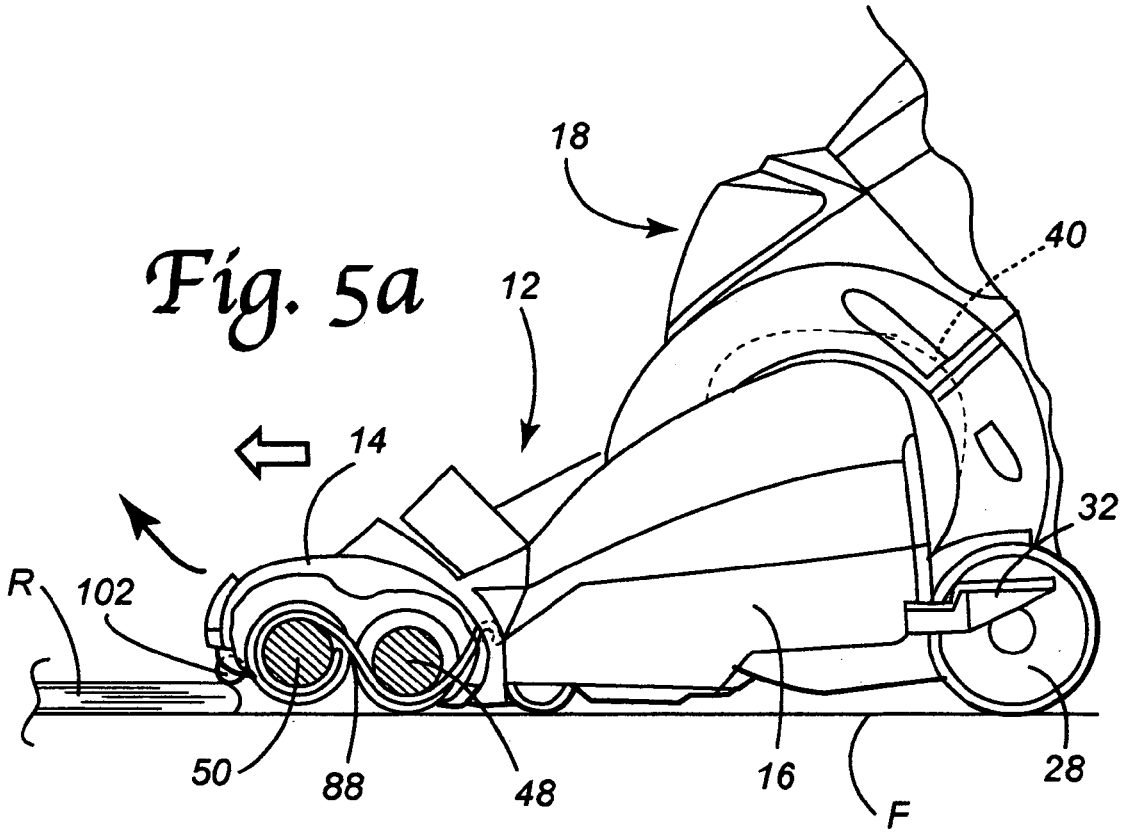
Figure 5B:
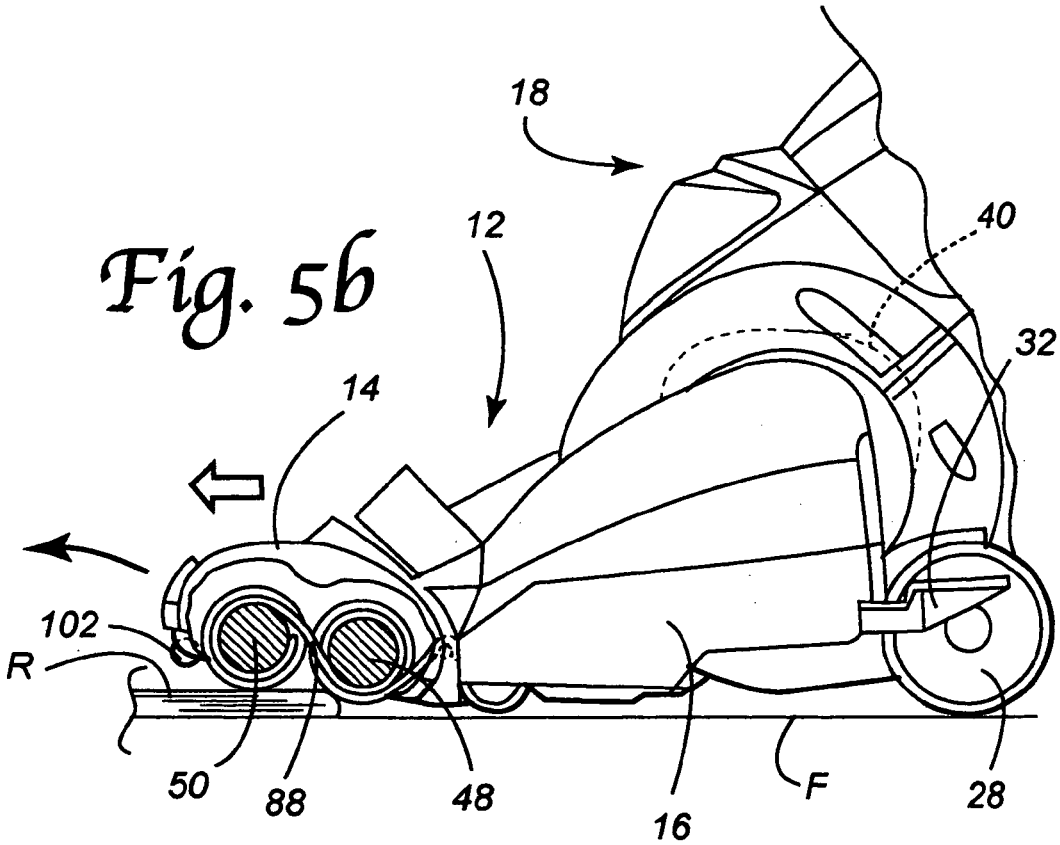
Figure 5C:
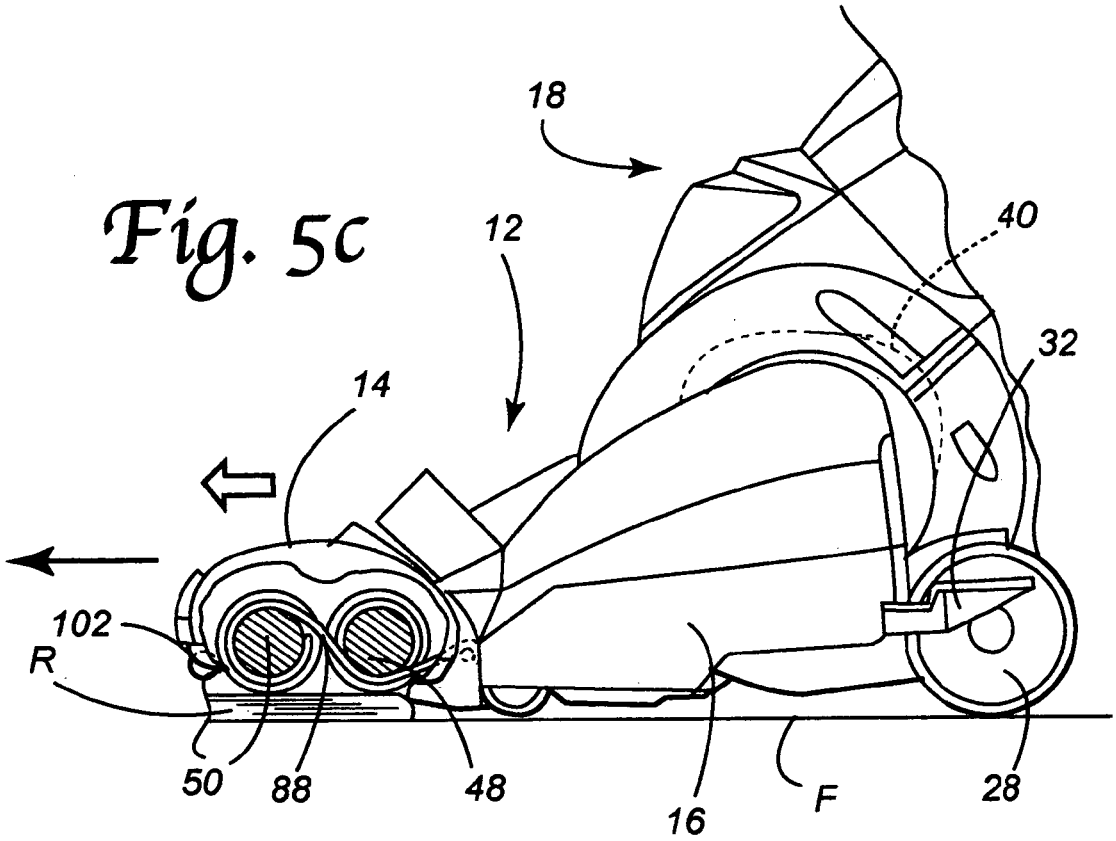
Figure 6:
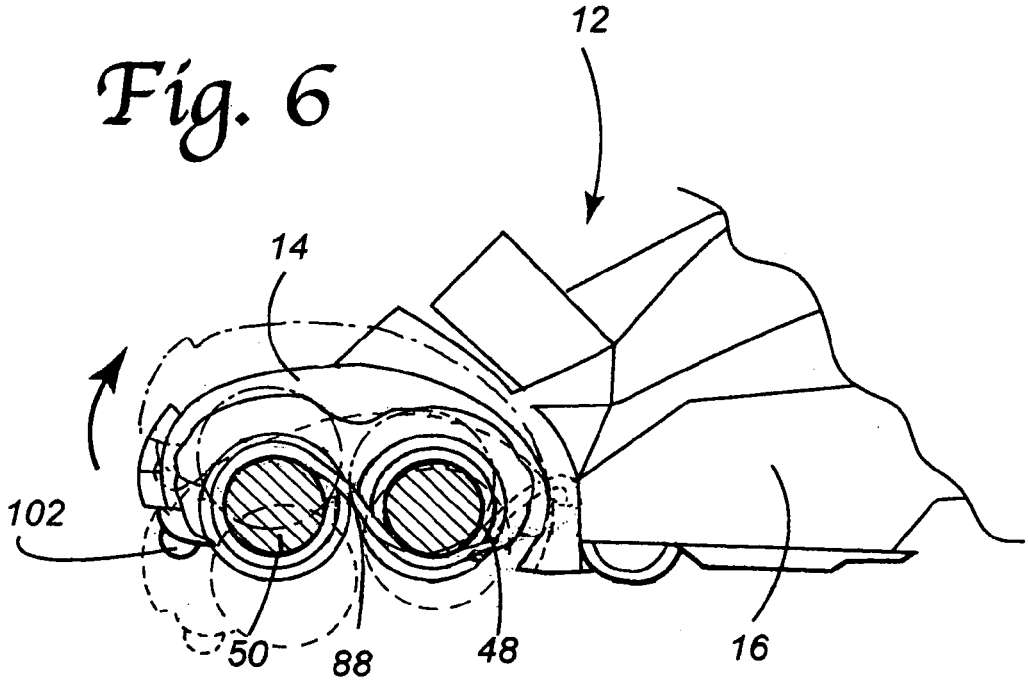

FIGS. 5*a*-5*c* schematically illustrate how the pivotally mounted agitator section allows the nozzle assembly to step over an edge of a rug while both maintaining good cleaning contact with both the floor and rug and also avoiding undue wear from the agitator on the edge of the rug; and FIG. 6 schematically illustrates the range of pivotal movement of the agitator section relative to the base section of the nozzle assembly.

Reference will now be made in detail to the present preferred embodiment of the invention, an example of which is illustrated in the accompanying drawing.

DETAILED DESCRIPTION OF THE INVENTION

Figure 1:
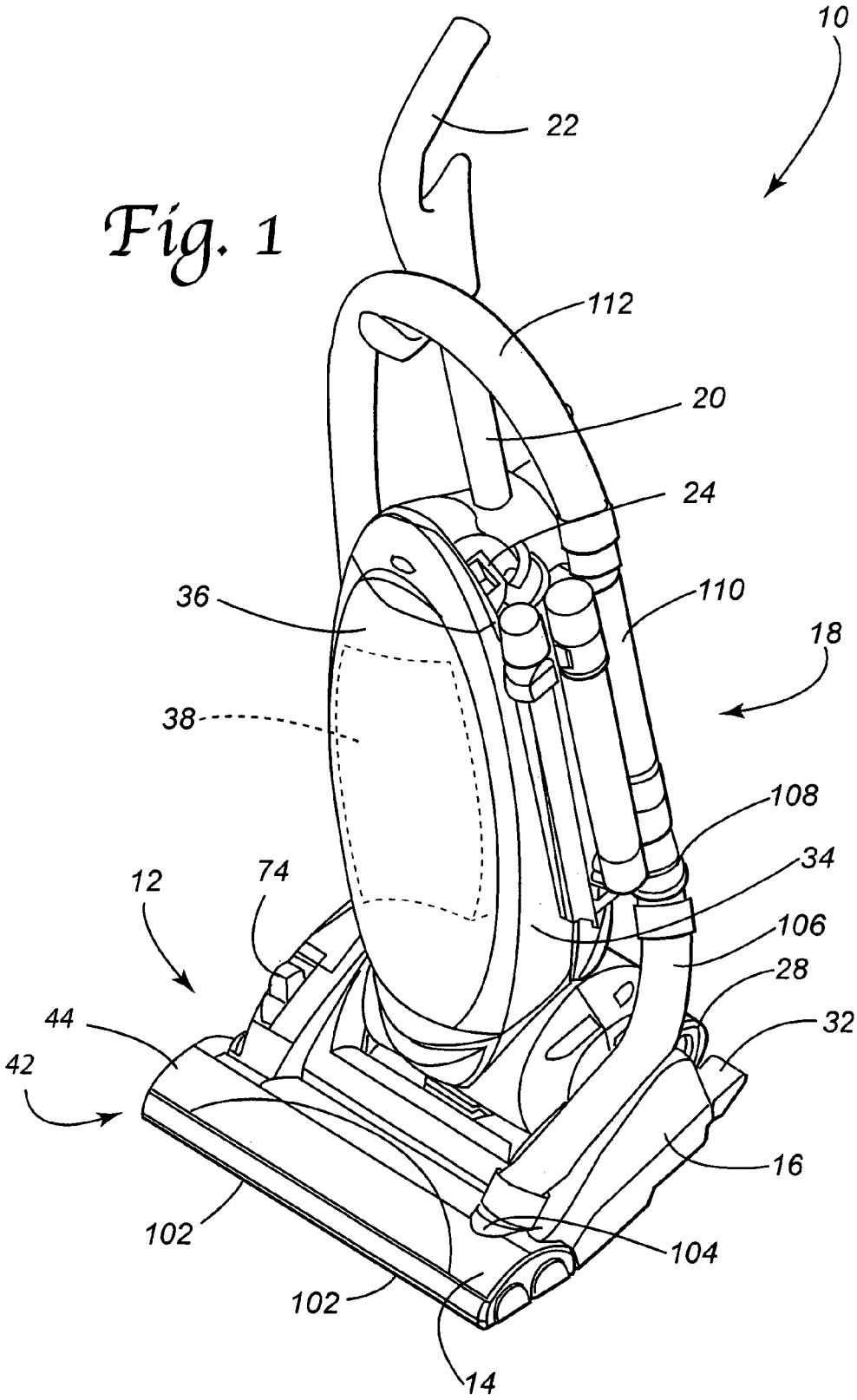
FIG. 1 is a perspective view of an upright vacuum cleaner of the present invention.
Figure 2:
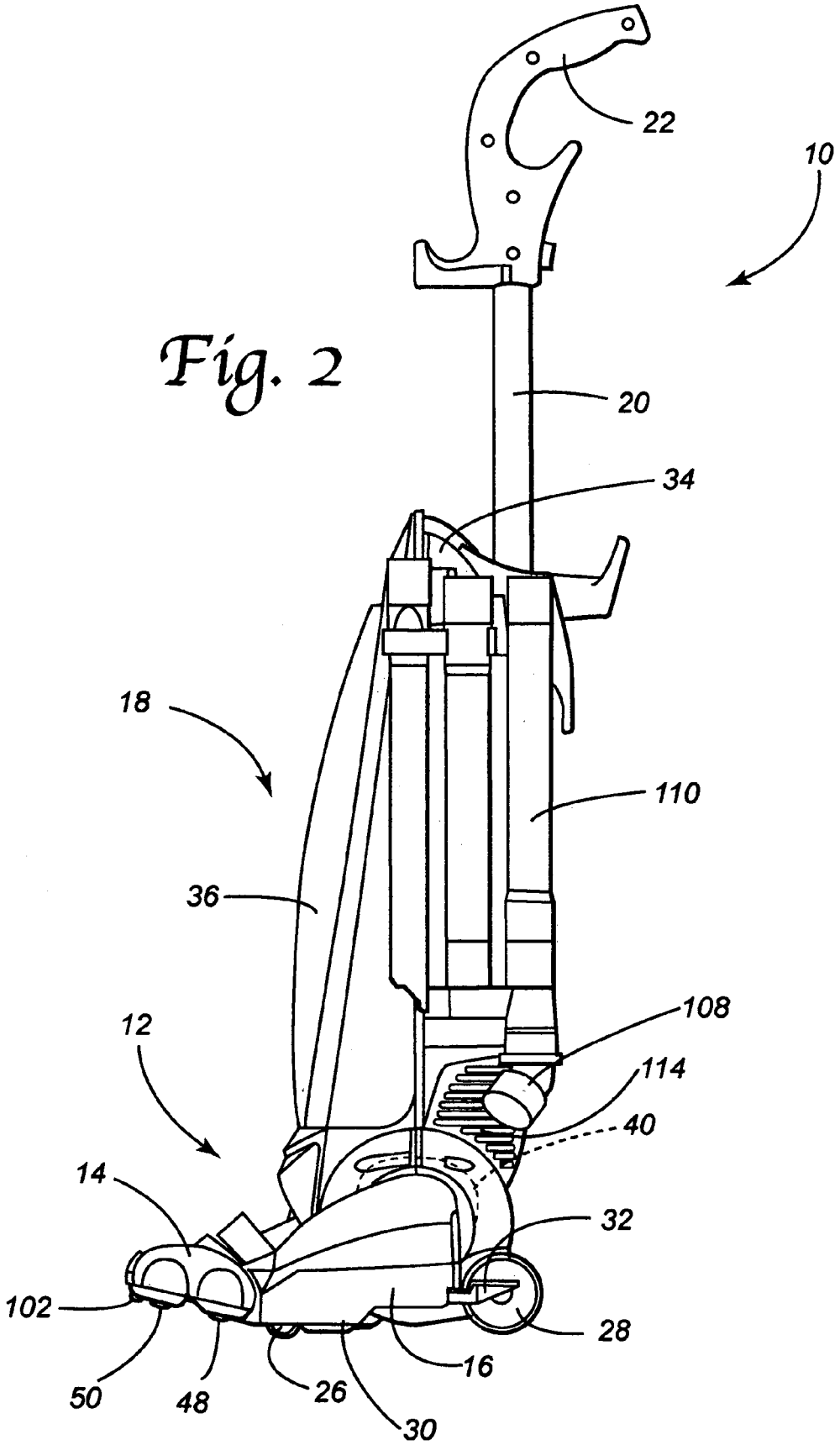
FIG. 2 is a side elevational view of the upright vacuum cleaner shown in FIG. 1.
Figure 3:
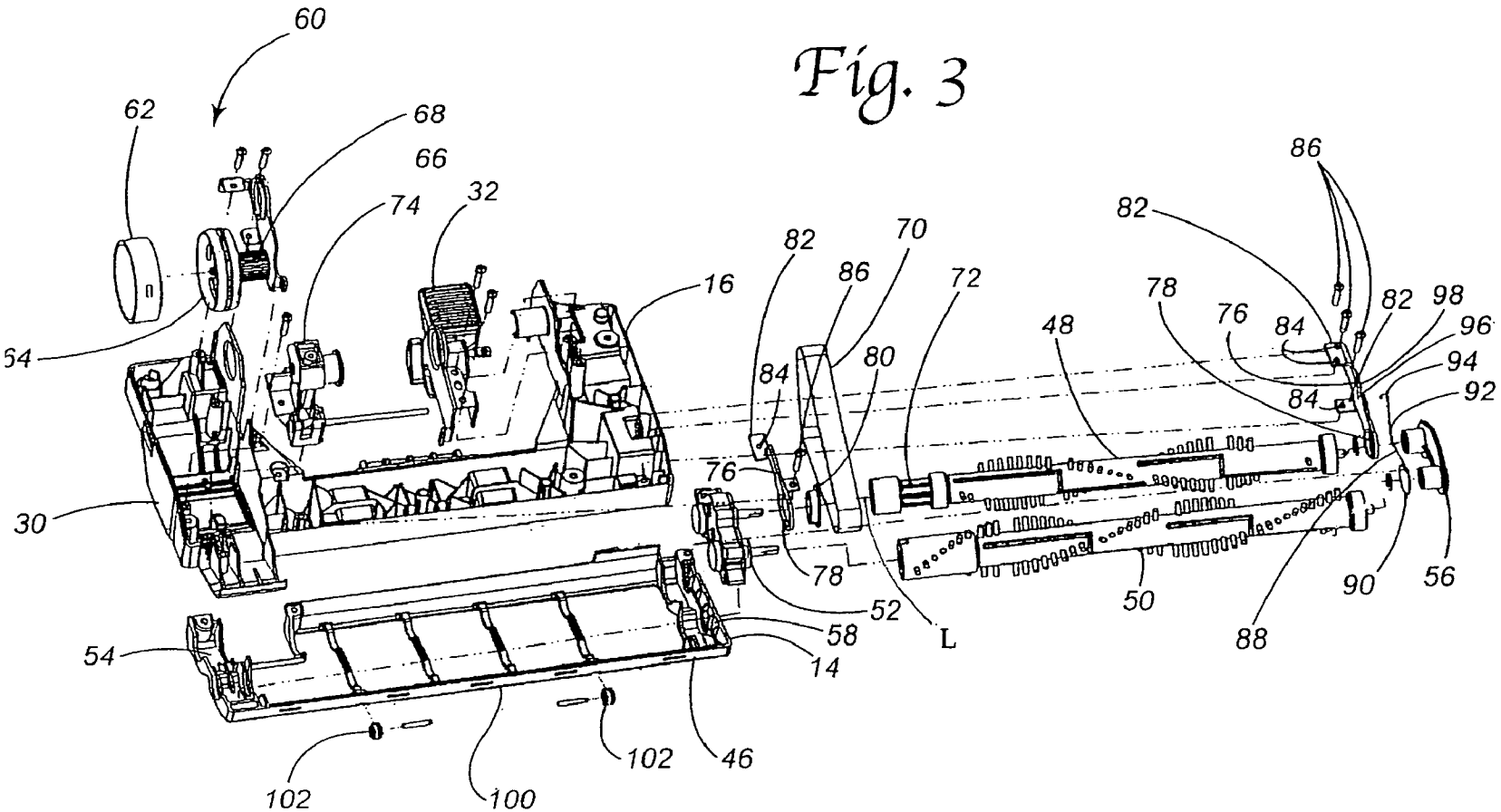
FIG. 3 is a detailed, exploded perspective view of the nozzle assembly of the upright vacuum cleaner illustrated in FIGS. 1 and 2.
Figure 4:
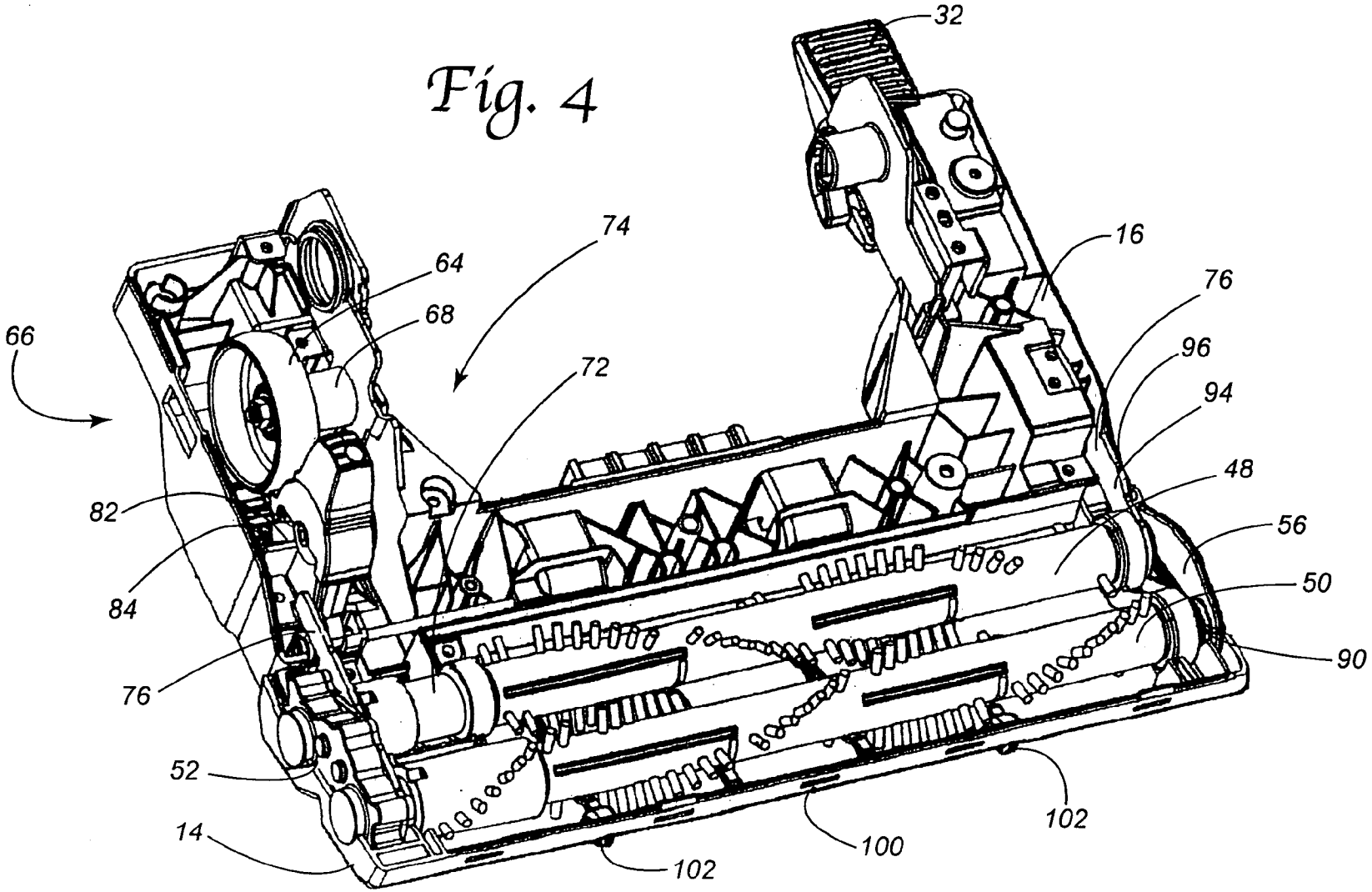
FIG. 4 is a perspective view showing the pivotal mounting of the agitator section to the base section of the nozzle assembly.

Reference is now made to FIGS. 1 and 2 showing the upright vacuum cleaner 10 of the present invention. The upright vacuum cleaner 10 includes a nozzle assembly 12, comprising both an agitator section 14 and base section 16, and a canister assembly 18. The canister assembly 18 further includes a control handle 20 and a hand grip 22. A control switch 24 is provided for turning the vacuum cleaner 10 on and off. Electrical power may be supplied to the vacuum cleaner 10 from a standard electrical wall outlet through an electrical cord (not shown) in a manner well known in the art. Alternatively, the vacuum cleaner 10 could be powered by an onboard battery or batteries.

The vacuum cleaner 10 glides over the surface to be cleaned by means of a pair of front wheels 26 and a pair of rear wheels 28. The front wheels 26 are rotatably mounted to the bottom plate 30 of the base section 16 of the nozzle assembly 12. In contrast, the rear wheels 28 are rotatably mounted to the canister assembly 18. Together, the wheels 26, 28 function to allow the vacuum cleaner 10 to roll smoothly across the surface during the cleaning operation.

In order to allow for convenient storage of the vacuum cleaner 10, a foot latch 32 functions to lock the canister assembly 18 in an upright position as shown in FIGS. 1 and 2. When the foot latch 32 is released, the canister assembly 18 may be pivoted relative to the base section 16 of the nozzle assembly 12 as the vacuum cleaner is manipulated back-and-forth to clean the floor.

As further illustrated in the drawing figures, the canister assembly 18 includes a main housing 34 that defines an internal cavity that is closed by a selectively removable main housing door 36. The cavity is adapted to receive and hold a dust bag 38 constructed from a filter material that functions to collect dirt and debris in a manner known in the art.

While the illustrated embodiment includes a cavity and dust bag 38, it should be appreciated that the vacuum cleaner 10 could just as easily be equipped with a removable dirt cup having a dirt collection chamber. That chamber may be cylindrical in shape and include a tangentially directed inlet opening in order to provide cyclonic airflow if desired.

As further illustrated in the drawing figures the canister assembly 18 also carries a suction generator 40 comprising a fan and drive motor. The suction generator 40 functions to generate a vacuum airstream for drawing dirt and debris from the surface to be cleaned. While the suction generator 40 is illustrated as being carried on the canister assembly 18, it should be appreciated that it could likewise be carried on the nozzle assembly 12 if desired.

As previously indicated, the nozzle assembly 12 includes both an agitator section 14 and a base section 16. As will become apparent as the description hereof proceeds, the agitator section 14 is pivotally mounted to the base section 16 so that the agitators are better able to follow the contour of the surface being cleaned in order to provide more efficient cleaning action without causing undue wear to vacuum cleaner components or the surface being cleaned.

As illustrated, the agitator section 14 includes a housing 42 having an upper portion or hood 44 and a lower portion or plate 46. The housing 42 defines an agitator cavity for holding a first rotary agitator 48 and a second rotary agitator 50. The agitators 48, 50 are interconnected at one end by means of a gear box assembly 52 held in a first socket 54 provided at one side of the agitator section 14. The opposite ends of the agitators 48, 50 are received in a bearing unit assembly 56 held in a second socket 58 at the opposite side of the agitator section 14.

In the illustrated embodiment the agitators 48, 50 are driven by the motor of the suction generator 40 through means of a power transmission generally designated by reference numeral 60. That power transmission comprises a first belt 62 connecting the output shaft of the motor of the suction generator 40 with a first pulley 64 of the step down pulley assembly 66. The first pulley 64 shares a common shaft with the second pulley 68 of the step down pulley assembly 66. A second belt 70 connects the second pulley 68 of the step down pulley assembly 66 with a pulley 72 formed as a part of the first agitator 48. During normal vacuum cleaner operation, rotary power is transferred from the drive shaft of the motor of the suction generator 40 through the first belt 62, first and second pulleys 64, 68 of the step down pulley assembly 66 and the second belt 70 to the first rotary agitator 48. The gear box assembly 52 transfers rotary motion from the first rotary agitator 48 to the second rotary agitator 50. A tensioner assembly, generally designated by reference numeral 74, may be actuated by the operator to detension the second belt 70 and thereby interrupt drive to the rotary agitators 48, 50 while allowing the motor to continue to drive the suction generator 40. This allows more efficient and effective bare floor cleaning.

The agitator section 14 is pivotally connected to the base section 16 of the nozzle assembly 12 by means of a pair of brackets 76. Each bracket 76 includes an aperture 78 that engages a bushing 80 at an end of the first rotary agitator 48. Thus, one bracket 76 is effectively captured between the first rotary agitator 48 and the gear box assembly 52 while a second bracket 76 is effectively captured between the opposite end of the rotary agitator 48 and the bearing unit assembly 56. As a result of the pivotal connection by the brackets 76, the agitator section 14 pivots about the longitudinal axis, L, of the first rotary agitator 48 through an arc of between about 10 degrees to about 25 degrees relative to the base section 16 (see FIG. 6). More specifically, the agitator section 14 will pivot upward above alignment with the base section 16 up to about 5 degrees. The agitator section 14 will also pivot downward below alignment with the base section 16 up to about 15 degrees. This free pivoting movement of the agitator section 14 relative to the base section 16 allows the agitators 48, 50 to follow floor contours and step over the raised edges of thresholds, rugs and the like with minimal resistance. This allows the user to smoothly and comfortably push the vacuum cleaner across substantially any surface to be cleaned.

As further illustrated, each bracket 76 includes a pair of projecting lugs 82. Each lug includes at least one aperture 84 for receiving a fastener 86 such as a screw. The fasteners 86 engage in threaded apertures provided on the bottom plate 30 of the base section 16 of the nozzle assembly 12. A spring 88 includes (a) a loop 90 received over a first portion of the bearing unit assembly 58 receiving an end of the second rotary agitator 50, (b) an intermediate bend 92 engaged by a second portion of the bearing unit assembly 56 that receives the end of the first rotary agitator 48 and (c) a hook end 94 that engages in a notch 96 on a top edge 98 of one of the brackets 76. While only one spring 88 is shown, it should be appreciated that if desired, a second, like spring may be provided at the opposite side of the agitator section 14 adjacent gear box assembly 52. Similarly no springs can be used if desired.

As should be appreciated, the spring 88 biases the agitator section 14 downwardly with respect to the base section 16 into engagement with the underlying floor. This spring 88 provides a biasing force to counteract the torque provided by the drive belt 70 and, accordingly, a positive downforce of approximately 0.5 newtons is provided on the agitator section 14 in order to maintain the agitators 48 and 50 in cleaning contact with the underlying floor.

It should be appreciated, however, that the pivotal mounting of the agitator section 14 to the base section 16 of the nozzle assembly 12 ensures that the agitator section 14 is capable of free movement in order to follow the contour of the floor including raised thresholds and the edges of rugs commonly provided over bare floors. As should be appreciated, the leading edge 100 of the agitator section 14 at the front of the vacuum cleaner 10 opposite the base section 16 includes at least two guide wheels 102. These guide wheels 102 are normally not in engagement with the floor but will, for example, come into engagement with raised features such as raised thresholds and the edges of rugs as the vacuum cleaner 10 is pushed across the floor.

As best illustrated with reference to FIGS. 5*a*-5*c*, upon engaging a raised floor feature, the wheels 102 roll over the feature raising the agitator section 14 against the biasing of the spring 88 so that the agitator section and the rotary agitators 48, 50 carried thereby, smoothly ride over the raised floor feature. At the same time the biasing downforce provided by the spring 88 ensures that the rotary agitators 48, 50 are maintained in cleaning contact with the feature. A delicate balance is achieved to ensure that cleaning contact is maintained without subjecting the feature to undue force through the rotary agitators 48, 50 so that excessive wear of the feature such as the edge of rug R on a bare floor F is avoided.

As the vacuum cleaner 10 is operated, the rotary agitators 48, 50 brush and beat dirt and debris from the nap of an underlying carpet being cleaned. That dirt and debris is drawn from the agitator cavity by the negative air pressure generated by the suction generator 40 into the inlet port 104 and then through the hose 106, wand fitting 108, wand 110 and hose 112 for delivery through an inlet (not shown) to the canister assembly 18 in communication with the dust bag 38. Dirt and debris is trapped in the dust bag 38 while clean air is then drawn through the suction generator 40 and passed over the motor of the suction generator to provide cooling. That air is then passed through a final filter (not shown) and exhausted into the environment through the exhaust port 114.

In summary, numerous benefits result from employing the concepts of the present invention. The pivotal mounting of the agitator section 14 to the base section 16 of the nozzle assembly 12 better ensures that the rotary agitators 48, 50 maintain a proper cleaning geometry relative to the surface being cleaned in order to provide the most efficient cleaning operation possible. The downforce provided by the spring 88 ensures that cleaning contact with the floor is maintained at all times. The pivoting movement of the agitator section 14 functions with the guide wheels 102 to ensure that the agitator section will also step over raised floor features such as raised thresholds in doorways and throw rugs provided on a carpet or a bare floor. Further, the step over is completed without subjecting the raised edge of the item to excessive wear resulting from high pressure contact with the rotary agitators. Advantageously, the spring loaded downforce provided on the agitator section 14 also serves to dampen vibrations resulting from contact of the rotary agitator with the surface being cleaned. Accordingly, fewer vibrations are transmitted to the operator who benefits from a more comfortable and less tiring cleaning experience.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiment do not and are not intended to limit the ordinary meaning of the claims and their fair and broad interpretation in any way.

The invention claimed is:

1. A floor cleaning apparatus, comprising:

a nozzle assembly including a base section and an agitator section pivotally mounted to said base section;

a canister assembly pivotally connected to said nozzle assembly;

a suction generator carried by one of said nozzle assembly and said canister assembly; and a dirt collector carried by one of said nozzle assembly and said canister assembly;

wherein said floor cleaning apparatus is characterized by;

said agitator section including an agitator housing, a first rotary agitator and a second rotary agitator; and said first rotary agitator including a longitudinal axis, said agitator section pivoting relative to said base section along said longitudinal axis.

2. The apparatus of claim 1, wherein said base section of said nozzle assembly includes at least one ground engaging wheel.

3. The apparatus of claim 2, wherein said canister assembly includes at least one ground engaging wheel.

4. The apparatus of claim 1 wherein said agitator section of said nozzle assembly includes at least one wheel.

5. The apparatus of claim 4, wherein said at least one wheel of said agitator section is provided adjacent a leading edge of said agitator section.

6. The apparatus of claim 1, wherein said canister assembly includes a control handle, said canister assembly being pivotally displaceable relative to said nozzle assembly between an upright, storage position and a use position.

7. The apparatus of claim 1, further including means for biasing said agitator section toward said surface being cleaned.

8. The apparatus of claim 1, further including at least one spring for biasing said agitator section toward said surface being cleaned.

9. The apparatus of claim 1, further including means for transmitting power from said suction generator to said first rotary agitator.

10. The apparatus of claim 9 wherein said means includes a belt.

11. The apparatus of claim 10, wherein said means includes a gear box assembly.

12. The apparatus of claim 1, further including an agitator drive motor carried on said nozzle assembly.

13. A vacuum cleaner, comprising:

a main housing including a plurality of wheels for engaging and rolling over a surface to be cleaned;

a suction generator; and an agitator section pivotally mounted to said main housing, said agitator section including an agitator housing, a first rotary agitator and a second rotary agitator and said first rotary agitator including a longitudinal axis, said agitator section pivoting relative to said main housing along said longitudinal axis.

14. The vacuum cleaner of claim 13, further including means for biasing said agitator section toward the surface to be cleaned.

15. The vacuum cleaner of claim 13, further including a pair of brackets for pivotally mounting said agitator section to said main housing.

16. The vacuum cleaner of claim 15, wherein each bracket of said pair of brackets includes an aperture for receiving an end of said first rotary agitator.

17. The vacuum cleaner of claim 16, wherein each bracket of said pair of brackets includes at least one lug and one fastener for securing each bracket to said main housing.

* * * * *